US007344167B2

(12) United States Patent
Johnson et al.

(10) Patent No.: US 7,344,167 B2
(45) Date of Patent: Mar. 18, 2008

(54) DOOR SECURITY APPARATUS

(76) Inventors: Elmer M. Johnson, 3530 Akron St., Loveland, CO (US) 80538; Philip H. Warren, Jr., 3010 Shopton Dr., Apex, NC (US) 27502

( * ) Notice: Subject to any disclaimer, the term of this patent is extended or adjusted under 35 U.S.C. 154(b) by 495 days.

(21) Appl. No.: 10/604,570

(22) Filed: Jul. 30, 2003

(65) Prior Publication Data

US 2005/0023842 A1 Feb. 3, 2005

(51) Int. Cl.
*E05C 19/18* (2006.01)

(52) U.S. Cl. ..... 292/288; 292/289

(58) Field of Classification Search ..... 292/288, 292/289, 291, 293, 259 R
See application file for complete search history.

(56) References Cited

U.S. PATENT DOCUMENTS

| | | | | |
|---|---|---|---|---|
| 463,361 | A | 11/1891 | Frazier | |
| 1,013,553 | A | 1/1912 | Johnson | |
| 3,367,700 | A * | 2/1968 | De La Cruz Carnicero | 292/288 |
| 3,583,737 | A | 6/1971 | Tutikawa | 292/16 |
| 4,020,965 | A | 5/1977 | Northup | 215/213 |
| 4,053,077 | A | 10/1977 | DeFelice | 215/217 |
| 4,082,334 | A | 4/1978 | Volta et al. | 292/288 |
| 4,116,434 | A * | 9/1978 | Bernstein | 482/140 |
| 4,213,534 | A | 7/1980 | Montgomery | 215/216 |
| 4,372,592 | A | 2/1983 | Beese | 292/288 |
| 4,915,430 | A | 4/1990 | Vitale | 292/145 |
| 5,147,052 | A | 9/1992 | Minette | 215/215 |
| 5,203,597 | A | 4/1993 | Wheelock | 292/258 |
| 5,291,760 | A | 3/1994 | Schrader | 70/14 |
| 5,381,917 | A | 1/1995 | Santagiuliana | 220/219 |
| 5,547,236 | A * | 8/1996 | Gregory | 292/148 |
| 5,579,561 | A * | 12/1996 | Smith et al. | 24/170 |
| 5,638,970 | A | 6/1997 | Garby et al. | 215/219 |
| 5,826,923 | A * | 10/1998 | Bethurem | 292/259 R |
| 5,934,718 | A | 8/1999 | La Valle | 292/289 |
| 5,984,386 | A | 11/1999 | Clemens | 292/288 |
| D418,038 | S | 12/1999 | Scott | D8/330 |
| 6,168,035 | B1 | 1/2001 | McLelland | 215/216 |
| 6,443,441 | B1 * | 9/2002 | Buitenhuis | 269/41 |

FOREIGN PATENT DOCUMENTS

| | | | |
|---|---|---|---|
| EP | 301143 | A1 | 2/1989 |

OTHER PUBLICATIONS

Safety 1st, Bi-Fold Door Lock, Sales Publication, Date 1990, Huntington Beach CA, USA.

* cited by examiner

*Primary Examiner*—Gary Estremsky
(74) *Attorney, Agent, or Firm*—Roger A. Jackson

(57) ABSTRACT

A door security apparatus and method that is adapted to assist in retaining a pair of adjacent doors in a closed state, thereby to help protect against unauthorized opening of the doors by placing the doors into an open state. The door security apparatus includes a channeled extension beam having a longitudinal axis, the beam is adapted to fit over and removably engage a pair of adjacent door edges that are in the closed state and a mechanism for manually selectively rotatably clamping or unclamping the beam to at least one door edge. Wherein the doors have increased protection against unauthorized opening, thus placing the doors into a more secured closed state, the mechanism only manually selectively clamping or unclamping the beam from the door edge by applying a manual external force in conjunction with manual forward or manual reverse rotation.

16 Claims, 3 Drawing Sheets

DOOR SECURITY APPARATUS

TECHNICAL FIELD

The present invention relates to door security devices in general and more particularly to a self contained door security apparatus that requires no keys or tumbler combinations to be remembered that provides increased protection against unauthorized opening of the door, thus placing the door into a more secured closed state. The door security apparatus utilizes a mechanism to only manually selectively remove the door security apparatus from the door allowing the door to be manually placed in the open state by the mechanism requiring the user to initiate a sequence of movements for removal of the door security apparatus from the door.

BACKGROUND OF INVENTION

The use of door security devices is well known in the prior art. Most of the door security devices being utilized require the use of keys, magnetic cards, smart cards, or the knowledge of a tumbler combination, which puts a burden on the user to retain either the keys, cards, or memorize the tumbler combination. If the door security device does not require the aforementioned keys, cards, or combinations, the security of the device is based on a non positive mechanical securing of the door, however, as the door security is not positive it can be disabled by merely loosening the mechanism that attaches the door security device to the door. A prior art example would be in U.S. Pat. No. 5,934,718 to La Valle that discloses an entertainment system cabinet locking device that includes a front extant and a planar configuration having an inverse "U" configuration that straddles between and over a pair of thinner type glass cabinet doors. The La Valle door clip that straddles between the cabinet doors and also between the door magnetic latches is merely a frictional type of clip that goes over the top edges of the doors, which does not provide positive security. Another prior art example is in U.S. Pat. No. 4,372,592 to Beese that discloses a locking device with a "U" shaped cross section for use with bi fold section type doors. The "U" shaped channel in Beese slips over the top of the bi fold doors while they are open resting upon a singular door section and when the bi fold doors are closed the channel is slid over the top edge to straddle two adjacent door sections, wherein a clip inserts between the two doors to prevent the channel from sliding axially, thus locking the doors in a shut position. However, in Beese as in La Valle this is just a frictional lock and not a positive security system for holding the bi fold door shut. Further, in U.S. Pat. No. 5,984,386 to Clemens disclosed is a portable public restroom door holding device for use when the restroom door has an inoperative or broken latch. Clemens has a "C" section having a pair of extension figures that fit over the top of the door and between the fixed doorpost structure. This door holding device has frictional gripping edges to more firmly stay in place in between the door in the post, however, is again not a positive security device.

A slightly more positive door securing device prior art example would be in U.S. Pat. No. 4,915,430 to Vitale that discloses a tamper resistant latch for glass doors, as in an entertainment system. Again, Vitale utilizes a "U" shaped bracket having an extension with an expanded end that slidably engages a latch slot to secure the door in the closed position. An option is also provided for a spring loaded expanded end to snap the door closed. However, Vitale is somewhat similar to Beese in that simply sliding the "U" shaped bracket releases the door to be open again making the latch not a positive security device. In U.S. Pat. No. 5,203,597 to Wheelock a universal lock is disclosed for use on doors, with the concept of preventing small children from gaining access to opening the door. Wheelock includes a pair of slidably engaged beams that telescopically engage, each having an opposing perpendicularly oriented bracket utilizing a thumbscrew fixing the distance between the perpendicularly oriented brackets on the telescopically engaged portion. The only somewhat positive security that Wheelock provides is to have the thumbscrew only be able to be loosened by a special type of wrench, however, this brings again the disadvantage similar to having to have a conventional key for a lock. Further, in U.S. Pat. No. 4,082,334 to Volta et al. being similar to Vitale disclosed is an interior security device for double doors that includes a plate that extends beyond the door knobs or handles having slots that slidably engage the neck portions of the handles with the slots narrower than the expanded end portions of the handles in order to secure the pair of door handles and thus the doors. Volta et al. is not necessarily secure as it can be simply slid off the door handle necks allowing for the doors to be opened, and especially in the case of a child would take a very minor amount of imagination on a child's part to disable the Volta et al. device. Similar to Volta et al. in U.S. Design Pat. No. D418,038 to Scott utilized is a bar or a beam that simply slidably engages the neck portions of the door handles, however, allowing the bar beam to simply be slid off of the neck portions to be able to open the doors. Also, in U.S. Pat. No. 3,583,737 to Tutikawa disclosed is a locking apparatus for swinging doors that is affixed to a stationary portion of the cabinet structure matably engaging with a pair of receptacles are engaging members attached to the doors. Tutikawa achieves a minor measure of security by having structure and linkage such that and the pair of doors may be sequenced to force one to open prior to the other. Similar to Turikawa in U.S. Pat. No. 1,013,553 to Johnson disclosed is a latch device for double doors, with the pair of cabinet doors independently latchable or in the alternative to automatically lock one of the doors when the other door is shut.

Looking at the prior art that does involve a sequence of movements to disable the door security device, European Patent Office publication number 301,143 A1 to Baines discloses a child resistant lock for a chest of drawers door that does use a sequence of a finger push mechanisms that are also sized for adult figures that would be difficult for a child to perform to unlock the mechanism. Although, Baines accomplishes the desired objective of having a child resistant lock on a door without the need for keys, cards, or combinations to be remembered, it involves a high degree of mechanical complication and complexity for economical mass production and sales.

Unfortunately, the aforementioned door security devices suffer from various disadvantages in that they do not provide positive security for keeping the door or doors shut or in a closed state without an unnecessary degree of mechanical complexity. Thus, what is needed is a door security apparatus that provides some measure of positive security for keeping the door or doors shut or in a closed state. In particular, a door security apparatus that would require a sequence of movements for removal of the apparatus from the door to allow the door to be placed in the open state. This sequence of movements would endeavor to be for the most part child proof in that a small child could not comprehend the requirement of the sequence of movements, wherein an older child or adult could comprehend the requirement of the sequence of movements thus being able to remove the door security apparatus from the door, placing the door into the open state and gaining access to the contents behind the door.

SUMMARY OF INVENTION

The present invention is a door security apparatus that is adapted to assist in retaining a pair of adjacent doors in a closed state, thereby to help protect against unauthorized opening of the doors by placing the doors into an open state. Broadly the present invention includes, a channeled extension beam having a longitudinal axis, wherein the beam is adapted to fit over and removably engage a pair of adjacent door edges that are in the closed state. Also included, is a means for manually selectively rotatably clamping or unclamping the beam to at least one door edge, wherein the doors have increased protection against unauthorized opening, thus placing the doors into a more secured closed state. The means only manually selectively clamping or unclamping the beam from the door edge by applying an external force in conjunction with forward or reverse rotation.

These and other objects of the present invention will become more readily appreciated and understood from a consideration of the following detailed description of the exemplary embodiment(s) of the present invention when taken together with the accompanying drawings, in which;

REFERENCE NUMBER IN DRAWINGS

Figure 1:
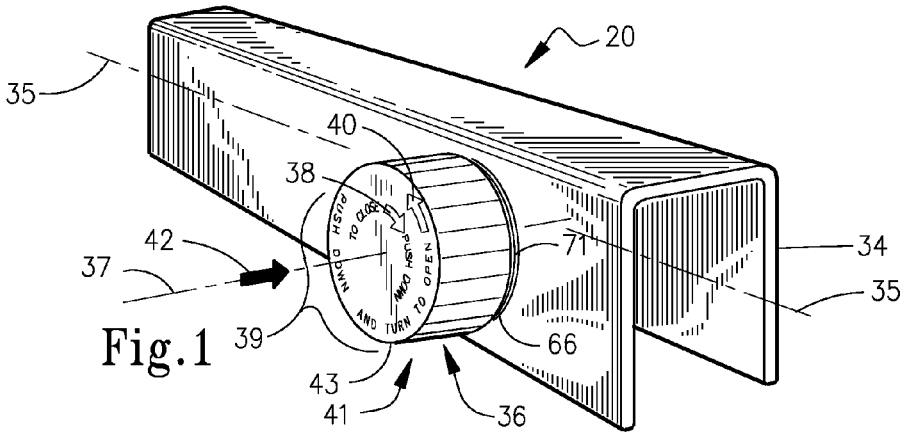
FIG. 1 shows a perspective view of the door security apparatus assembly.

20 Door Security Apparatus
22 Door
23 Door edge
24 Cabinet door
26 Bi fold door
28 Door hinge
30 Door handle
32 Doorframe
33 Door opening movement
34 Channel extension beam
35 Channel extension beam longitudinal axis
36 Means for selectively rotatably clamping or unclamping the beam 34
37 Means for selectively rotatably clamping or unclamping the beam 34 rotational axis
38 Tightening forward rotation of means 36
39 Indicia visibly disposed on means 36
40 Loosening reverse rotation of means 36
41 Ratchet cap assembly
42 External force upon means 36 during forward 38 or reverse rotation 40
43 Ratchet cap outer shell
44 Ratchet cap outer shell axial protrusion tightening sides
45 Ratchet cap outer shell axial protrusions
46 Ratchet cap insert
47 Ratchet cap insert axial nodes
48 Ratchet cap outer shell axial protrusion loosening sides
49 Ratchet cap retainer to ratchet cap insert
50 Ratchet cap insert axial node tightening face
51 Ratchet cap insert internal thread
52 Ratchet cap insert axial node loosening face
54 Fastener
56 Extension member
58 Extension member slidable contact
59 Fastener counterbore
60 Extension member extension
62 Extension member aperture
64 Extension member interface
66 Channel extension beam externally threaded element
67 Channel extension beam externally threaded element shoulder
68 Channel extension beam externally threaded element external thread
70 Channel extension beam externally threaded element aperture therethrough
71 Beam opening for the externally threaded element 66
72 Clamping member
74 Clamping member door contact surface
76 Clamping member prolongation
78 Clamping member attachment
80 Clamping member webs
82 Clamping member fastener receiver
84 Clamping member fastener receiver internal thread
86 Portion of beam adapted to fit over and removably engage the door edge 23
88 Remainder of beam adjacent to the frame 32
90 Acute angle between loosening face 52 and loosening side 48

DETAILED DESCRIPTION

Figure 2:
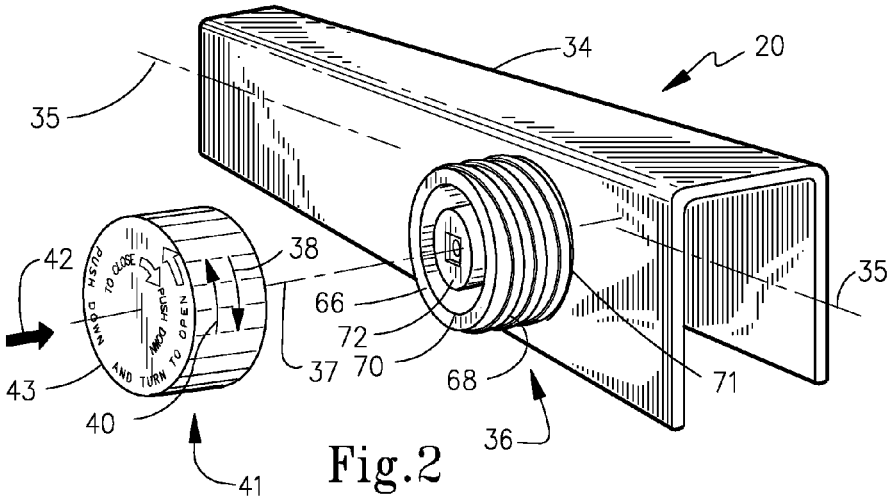
FIG. 2 shows a perspective view of the door security apparatus assembly with the ratchet cap assembly separated from the door security apparatus assembly.
Figure 3:
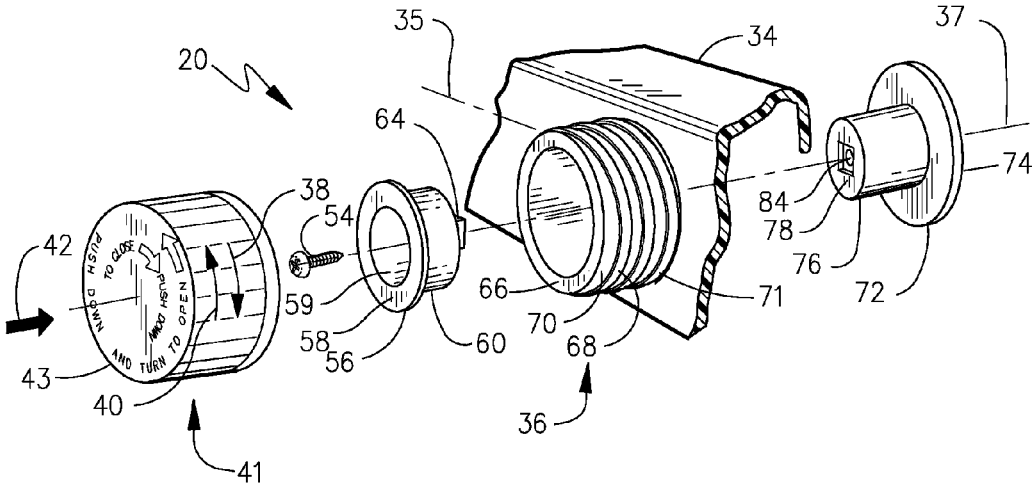
FIG. 3 shows an exploded perspective view of the means for selectively rotatably clamping or unclamping the beam.
Figure 4:
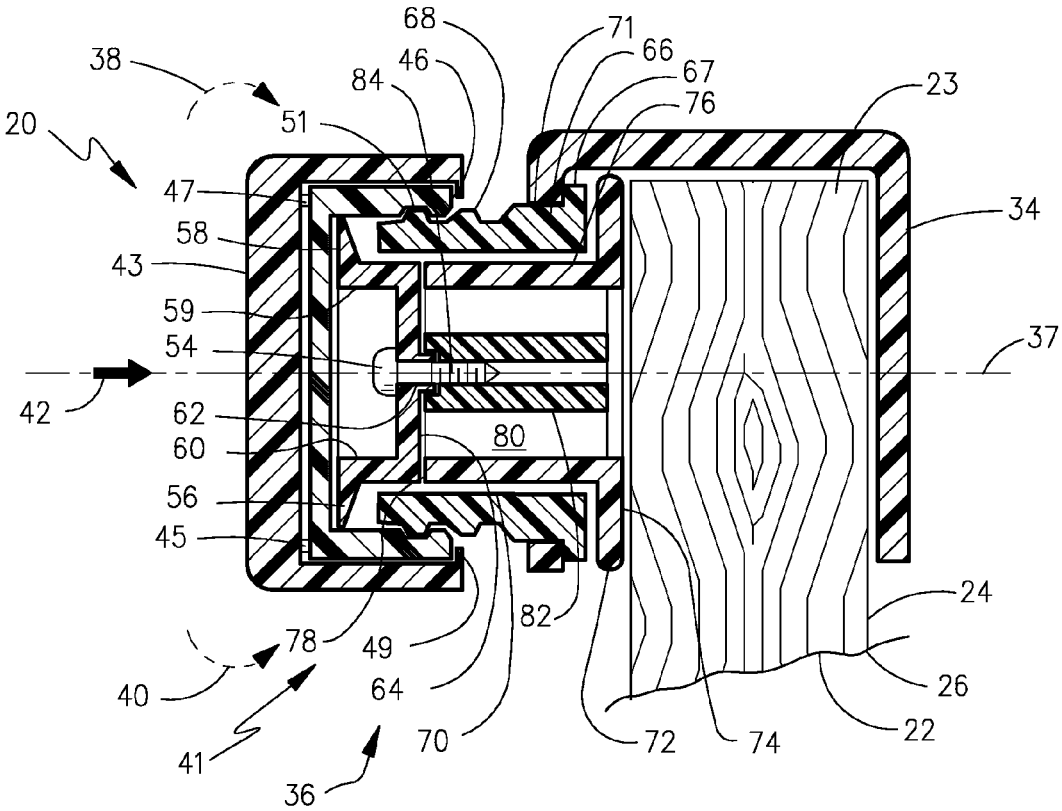
FIG. 4 shows the crossection of the means for selectively rotatably clamping or unclamping the beam to the door, being denoted as section 4-4 from FIGS. 7, 8, and 9.
Figure 5:
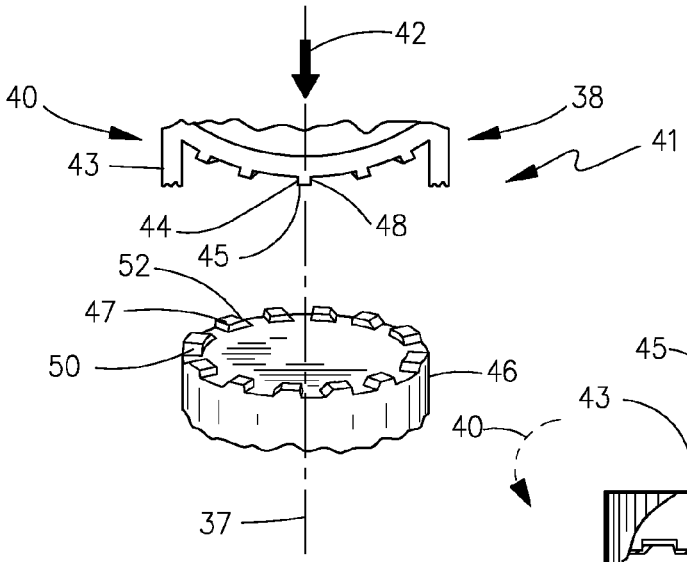
FIG. 5 shows an exploded perspective view of the ratchet cap outer shell and ratchet cap insert, specifically with the ratcheting interface shown.
Figure 6:
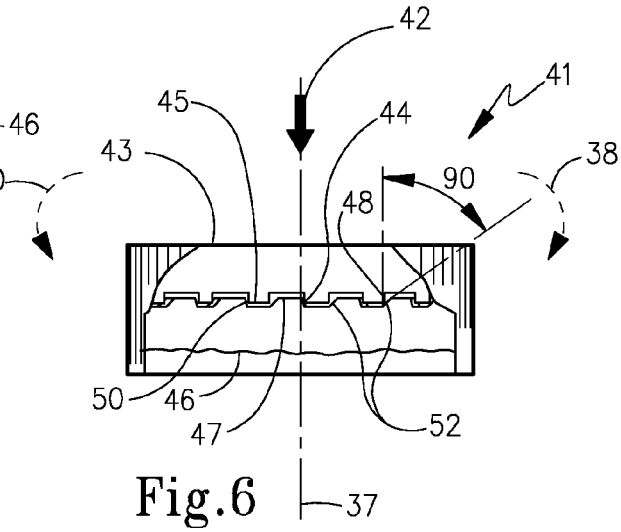
FIG. 6 shows an assembled crossectional view of the ratchet cap outer shell and ratchet cap insert, specifically with the ratcheting interface shown.

With initial reference to FIGS. 1 though 6, FIG. 1 shows a perspective view of the door security apparatus assembly 20, FIG. 2 shows a perspective view of the door security apparatus assembly 20 with the ratchet cap assembly 41 separated from the door security apparatus assembly 20, and FIG. 3 shows an exploded perspective view of the means 36 for selectively rotatably clamping or unclamping the beam 34. Further, FIG. 4 shows the crossection of the means 36 for selectively rotatably clamping or unclamping the beam 34 to the door (not shown), being denoted as section 4-4 from FIGS. 7, 8, and 9. Also, FIG. 5 shows an exploded perspective view of the ratchet cap outer shell 43 and ratchet cap insert 46, specifically with the ratcheting interface shown and FIG. 6 shows an assembled crossectional view of the ratchet cap outer shell 43 and ratchet cap insert 46, specifically with the ratcheting interface shown.

Figure 7:
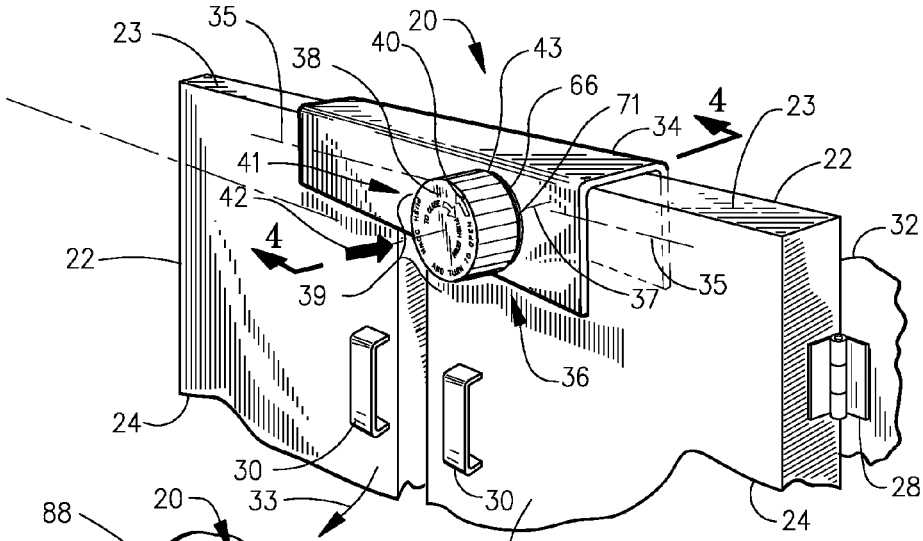
FIG. 7 shows a perspective use view of the door security apparatus clamped over a pair of cabinet doors on the opening non hinge ends.
Figure 8:
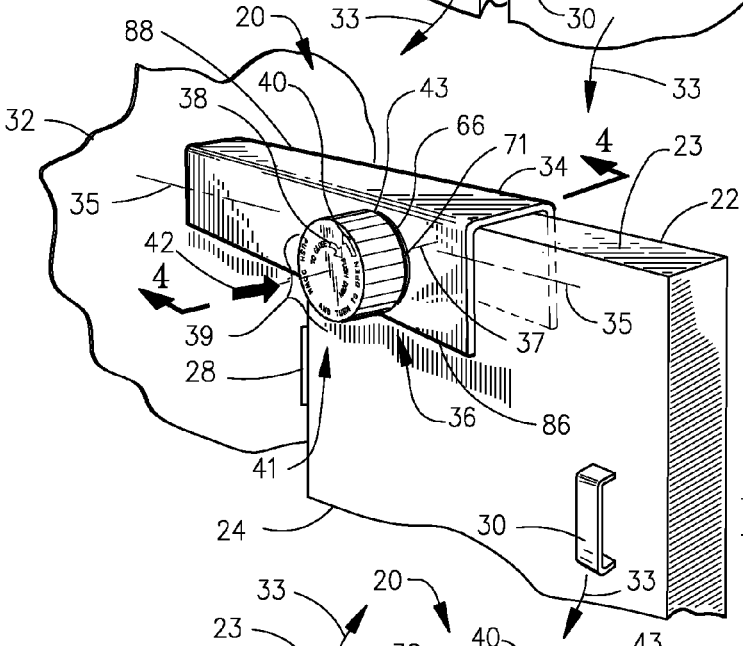
FIG. 8 shows a perspective use view of the door security apparatus clamped over a cabinet door on the hinge end.
Figure 9:
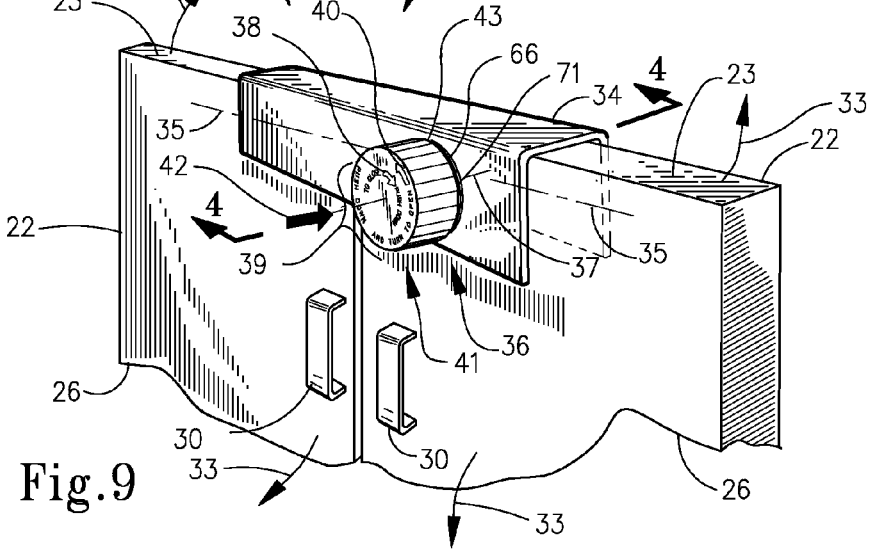
FIG. 9 shows a perspective use view of the door security apparatus clamped over a pair of bi fold doors.

Broadly, the exemplary embodiment of the present invention of a door security apparatus 20 is adapted to assist in retaining a pair of adjacent doors 22 or bi fold doors 26 (as best shown in FIGS. 7 and 9 respectively) in a closed state, thereby to help protect against unauthorized opening, for instance by a child, of the doors 22 by placing the doors into an open state. The door security apparatus 20 includes a channeled extension beam 34 that has a longitudinal axis 35, with the beam 34 being adapted to fit over and removably engage a pair of adjacent door edges 23 (as best shown in FIGS. 7 and 9) that are in the closed state. Also included is a means 36 for manually selectively rotatably clamping or unclamping the beam 34 to at least one door edge 23, wherein the doors 22 have increased protection against unauthorized opening, thus placing the doors 22 into a more secured closed state. The means 36 only manually selectively clamping or unclamping the beam 34 from the door edge by applying an external force 42 in conjunction with forward 38 or reverse 40 rotation respectively. As an alternative embodiment the door security apparatus 20 can be adapted to assist in retaining a door 22 (as best shown in FIG. 8) in a closed state, thereby to help protect against unauthorized opening, for instance by a child, of the door by placing the door into an open state. Wherein, the door 22 is hinged 28 to a doorframe 32 on one side approximately perpendicular to a door edge 23. The door security apparatus 20 in the alternative embodiment includes a channeled extension beam 34 that has a longitudinal axis 35, with a portion 86 of the beam 34 being adapted to fit over and removably engage a door edge 23 (as best shown in FIG. 8) and a remainder 88 of the beam 34 being adjacent to the door frame 32 when the door 22 is in the closed state. Also in the alternative embodiment, included is a means 36 for manually selectively rotatably clamping or unclamping the beam 34 to the door edge 23, wherein the door 22 has increased protection against unauthorized opening, thus placing the door 22 into a more secured closed state. Again, also in the alternative embodiment, the means 36 only manually selectively clamping or unclamping the beam 34 from the door edge 23 by applying an external force 42 in conjunction with forward 38 or reverse 40 rotation respectively. The following description applies equally to both the aforementioned exemplary embodiment and the alternative embodiment.

The typical materials of construction for the door security apparatus 20 are for the beam 34 materials selected from the group consisting essentially of polyethylene, polypropylene, and polyurethane materials. However, any other type of plastic material would also be acceptable given that the functional and strength requirements are meet to resist a child being able to overcome the beam 34 bending strength and gaining access to the contents behind the doors by placing the doors in an open state. Additionally, other materials such as steel, aluminum, and the like would also be acceptable while meeting the afore mentioned requirements for the beam 34. For the materials of construction on the means 36 for manually selectively rotatably clamping or unclamping the beam 34, the means 36 materials would typically be materials selected from the group consisting essentially of polyethylene, polypropylene, and polyurethane materials. However, any other type of plastic material would also be acceptable given that the functional and strength requirements are meet to resist a child being able to overcome the clamping strength of the means 36 of clamping the beam 34 to at least one door edge and allowing access to the contents behind the doors by placing the doors in an open state. Additionally, other materials such as steel, aluminum, and the like would also be acceptable while meeting the aforementioned requirements for the means 36.

Although, FIGS. 1 through 9 show a single means 36 for manually selectively rotatably clamping or unclamping the beam 34 to at least one door edge, a plurality of means 36 for manually selectively rotatably clamping or unclamping the beam 34 could be utilized to further strengthen the attachment of the beam 34 to the pair of adjacent doors 22 to enhance the protection against unauthorized opening of the doors 22. The added means 36 for manually selectively rotatably clamping or unclamping the beam 34 to the door edge 23 could be utilized such that a means 36 clamps upon each door 22 of the pair of adjacent doors 22 and/or multiple means 36 could be used to clamp on one of the doors 22 of the pair of doors 22. In any case, using additional means 36 will further strengthen the beam 34 clamp upon the door 22 or doors 22 thus better protecting against unauthorized opening of the doors 22.

More particularly, and referring for the most part to FIG. 4, on the means 36 for manually selectively rotatably clamping or unclamping the beam 34 to at least one door 22 edge 23 or alternatively a cabinet door 24 or bi fold door 26 (also reference FIGS. 7, 8, and 9) the means 36 comprises a ratchet cap assembly 41 that has an internal thread 51 with a beam externally threaded element 66 and specifically an externally threaded element external thread 68, wherein the beam externally threaded element 66 is adjacent to the beam 34. Thus, the ratchet cap assembly 41 internal thread 51 is threadably engaged with the externally threaded element external thread 68. The beam externally threaded element 66 also has an aperture 70 therethrough, wherein the aperture 70 continues therethrough not only through the beam externally threaded element 66 but also the beam 34. The attachment of the externally threaded element 66 to the beam 34 is shown as a shoulder 67 of the externally threaded element 66 resting against the beam 34 with an opening 71 in the beam 34 accommodating the externally threaded element 66 in a shrink fit or slip fit arrangement. The shown arrangement for attachment of the externally threaded element 66 and the beam 34 could also be additionally secured by an adhesive suitable for the aforementioned materials of construction. Note that the shoulder 67 is operational to act against the closing force of the means 36 as the means 36 is pushing outward from within the beam 34 to clamp the door 22. Additionally, other types of attachment between the externally threaded element 66 and the beam 34 could include making the two aforementioned elements integral, or a screwed attachment, or other attachment types known in the art that would have the strength to maintain the clamp of the means 36 and thus the clamp of the beam 34 on the door 22. The positioning of the beam externally threaded element 66 in relation to the beam 34 (as best shown in FIGS. 1, 2, 3, 4, and FIGS. 7 through 9) are such that the beam externally threaded element 66 is substantially symmetric to a means rotational axis 37 that is substantially perpendicular to the beam 34 longitudinal axis 35, with the intersection of the means rotational axis 37 and the beam 34 longitudinal axis 35 along the longitudinal axis 35 such that the means 36 clamps the beam 34 to the door 22. The ratchet cap assembly 41 only having rotational, being the forward 38 or reverse 40 rotation being substantially about the means rotational axis 37 with axial movement along the means rotational axis 37 facilitated by the threadable engagement of the internal thread 51 being threadably engaged with the externally threaded element external thread 68 with the application of the manual external force 42 in conjunction with the manual forward 38 or reverse 40 rotation upon the ratchet cap assembly 41. The external force 42 is approximately parallel to the means rotational axis 37 toward the beam 34. In addition, an extension member 56 and a clamping member 72 are both in slidable axial contact with the ratchet cap assembly 41 axially substantially along the means rotational axis 37. Both the extension member 56 and the clamping member 72 are disposed through the aperture 70 therethrough and are operational to clamp and unclamp the beam 34 to at least one door edge 23. Note that both the extension member 56 and the clamping member 72 are preferably not rotationally engaged to the ratchet cap assembly 41 being the forward 38 or reverse 40 rotation to not have the clamping member 72 rotationally engaging the door edge 23, thus the clamping member 72 only applying axial force along the means rotational axis 37 to the door edge 23. However, if the clamping member 72 does rotationally engaging the door edge 23 from the forward 38 or reverse 40 rotation of the ratchet cap assembly 41, it would be acceptable as the application of axial force along the means rotational axis 37 to the door edge 23 would still occur, however, requiring additional manual forward 38 or reverse 40 rotational force on the ratchet cap assembly 41.

Focusing in particular on the ratchet cap assembly 41 and referring for the most part to FIGS. 5 and 6, the ratchet cap assembly 41 is comprised of a ratchet cap outer shell 43 that has a rotationally releasably engagable interface or known as the ratcheting interface, with a ratchet cap insert 46. Wherein the ratchet cap outer shell 43 operationally accepts the manual external force 42 and the forward 38 or reverse 40 rotation that is applied manually. The ratchet cap insert 46 has a threadable engagement with the beam externally threaded element 66 by way of the threadable engagement of the internal thread 51 being threadably engaged with the externally threaded element external thread 68 causing axial movement along the means rotational axis 37 either toward the beam 34 with manual forward 38 or tightening rotation and axial movement away from the beam 34 from manual reverse 40 or loosening rotation. In the absence of the manual external force 42 the ratchet cap outer shell 43 and the ratchet cap insert 46 are operational to allow free rotational movement to one another, thus without the external force 42, manually applying forward 38 or reverse 40 rotation will do nothing more than cause the ratchet cap outer shell 43 to rotationally free wheel as against the ratchet cap insert 46 and not advance the aforementioned threadable engagement axially either toward the beam 34 or away from the beam 34 as previously described along the means rotational axis 37. To retain the ratchet cap outer shell 43 to the ratchet cap insert 46 even while able to free wheel as previously described, a ratchet cap retainer 49 to ratchet cap insert 46 is utilized to keep the ratchet cap outer shell 43 from separating from the ratchet cap insert 46. The extension member 56 and the clamping member 72 are both in slidable axial contact with the ratchet cap insert 46 axially along the means rotational axis 37. Both the extension member 56 and the clamping member 72 are disposed through the aperture 70 therethrough and are operational to clamp and unclamp the beam 34 to at least one door edge 23. Note that both the extension member 56 and the clamping member 72 are preferably not rotationally engaged to the ratchet cap insert 46 being the manual forward 38 or manual reverse 40 rotation to not have the clamping member 72 rotationally engaging the door edge 23, thus the clamping member 72 only applying axial force along the means rotational axis 37 to the door edge 23. This is accomplished by a rotationally slidable engagement between the interface of the extension member slidable contact 58 and the ratchet cap insert 46 as best shown in FIG. 4. However, if the clamping member 72 does rotationally engage the door edge 23 from the manual forward 38 or manual reverse 40 rotation of the ratchet cap assembly 41, it would be acceptable as the application axial force along the means rotational axis 37 to the door edge 23 would still occur, requiring additional manual forward 38 or manual reverse 40 rotational force to the ratchet cap assembly 41. Referencing FIGS. 3 and 4 in particular, thus looking in more detail at the extension member 56 and the clamping member 72 it can be seen from FIG. 4 that the axial positioning of the extension member 56 and the clamping member 72 along the means rotational axis 37 is at a mid point of axial movement with gaps or clearances between aforementioned elements slightly exaggerated for pictorial clarity. The extension member 56 and the clamping member 72 are attached by fastener 54, with the head of fastener 54 disposed within a counter bore 59 that forms the inside diameter of an extension member extension 60 terminating in the slidable contact 58 as previously described. The fastener 54 utilizes the extension member aperture 62 to threadably attach to the clamping member 72 by way of a clamping member fastener receiver internal thread 84 being within a clamping member fastener receiver 82 that is attached to the clamping member 72 by clamping member webs 80. Note, that the axial interface between the extension member 56 and the clamping member 72 occurring at an extension member interface 64 and a clamping member attachment 78 forms an axial contact along the means rotational axis 37, however, it is not required that this axial interface be rotationally slidable or rotationally lockable to function properly, either is acceptable for reasons previously described. The clamping member 72 also includes a clamping member prolongation 76 that is inbetween the clamping member attachment 78 and a clamping member door 22 contact surface 74. The contact surface 74 typically has a larger area to reduce the chances for damage to the door 22 from the clamping force of the means 36 along the means rotational axis 37. The previous description of extension member 56 and the clamping member 72 are for the exemplary emplary and/or alternative embodiments, however, items such as the attachment between the extension member 56 and the clamping member 72 utilizing the fastener 54 could be accomplished by a number of other ways, such as adhesives, snap, or shrink fit, and the like that are adequate to hold the extension member 56 and the clamping member 72 together to retain them in the aperture 70 thus preventing the extension member 56 and the clamping member 72 from becoming separated from the channel extension beam externally threaded element 66. In addition, the construction of the extension member 56 and the clamping member 72 can differ from what is shown in FIG. 4 in that the clamping member 72 could be of solid construction without the clamping member fastening receiver 82 or clamping member webs 80. Likewise, the extension member 56 the counterbore 59 could be eliminated depending upon the use of a different fastener type as previously discussed.

Continuing to focus in particular on the ratchet cap assembly 41 and referring for the most part to FIGS. 5 and 6, and specifically on the ratchet cap outer shell 43 that has a rotationally releasably engagable interface with the ratchet cap insert 46. The rotationally releasably engagable interface between the ratchet cap outer shell 43 and the ratchet cap insert 46 is preferably constructed of a plurality of radially positioned axial protrusions 45 that are disposed within the ratchet cap outer shell 43. Each of the protrusions 45 including substantially parallel sides with one side for tightening 44 and one side for loosening 48. The ratchet cap insert 46 also includes a plurality of radially positioned axial nodes 47 that are adjacent to the protrusions 45, when the ratchet cap outer shell 43 and the ratchet cap insert 46 are assembled together as shown in FIGS. 4 and 6. Note, that in FIG. 6, the protrusions 45 and the nodes 47 are shown engaged, however, the ratchet cap outer shell 43 and the ratchet cap insert 46 are separable axially along the means rotational axis 37 away from each other so that the protrusions 45 and the nodes 47 are not engaged and do not contact each other for the free wheeling condition between the ratchet cap outer shell 43 and the ratchet cap insert 46 as previously described while the previously described retainer 49 axially limits the separation of the ratchet cap outer shell 43 and the ratchet cap insert 46 for the free wheeling condition without allowing the ratchet cap outer shell 43 and the ratchet cap insert 46 to axially separate completely. Each of the nodes 47 includes non parallel faces with a tightening face 50 that is substantially positionally parallel to the tightening side 44, each node 47 also includes a loosening face 52 that forms an acute angle 90 with the loosening side 48. Operationally, the protrusions 45 and nodes 47 are operational to allow free wheel rotational movement between the ratchet cap outer shell 43 and the ratchet cap insert 46 without the application of the manual external force 42, also to allow forward tightening manual rotation 38 resulting in rotational engagement between the ratchet cap outer shell 43 and the ratchet cap insert 46 upon the manual application of a lower external force 42 and to allow reverse loosening manual rotation 40 resulting in rotational engagement between the ratchet cap outer shell 43 and the ratchet cap insert 46 upon the manual application of a higher external force 42. Although a particular embodiment of the ratchet cap assembly 41 has been described, other variations of a ratchet cap assembly 41 having a similar function could be utilized such as, a flexible or rigid tang or tangs either axially or radially displaced, and the like. In order for a user of the means 36 for selectively rotatably clamping or unclamping the beam 34 to at least one door edge 23 to easily clamp and unclamp the beam 34 to the door edge 23 instructional indicia 39 is visibly disposed on the means 36 or in particular on the ratchet cap assembly 41 and specifically the ratchet cap outer shell 43 as is best shown in FIG. 1, with the instructional indicia 39 being operational to give instructions to a user for manually selectively rotatably clamping or unclamping the beam 34 to at least one door edge 23.

Thus, the ratchet cap outer shell 43 and the ratchet cap insert 46 which form the ratchet cap assembly 41 act to be a child resistant device by requiring the user to be able to read and understand the indicia 39 prior to successfully operating the means 36 for selectively rotatably clamping or unclamping the beam 34 to at least one door edge 23. The present invention of the door security apparatus 20 utilizes the child resistant cap type device, however, instead of using the cap to seal a medicine bottle, the child resistant cap is converted into creating an opening and closing axial force along the means 36 rotational axis 37 to clamp and unclamp the beam 34 from inbetween a pair of doors, being cabinet type doors 22 as shown in FIG. 7, or bi fold doors 26 as shown in FIG. 9, or between a single door 22 and the frame 32 as shown in FIG. 8. With the beam 34 clamped to the door 22 or doors 22 in any case the door security apparatus will help prevent the unauthorized opening of the door 22 or doors 22 by especially a baby or small child.

METHOD OF USE

Referring particularly to FIGS. 7 and 9, a method is described of using the exemplary embodiment of the door security apparatus 20 that is adapted to assist in retaining a pair of adjacent opposing doors 22, being either cabinet doors 24 or bi fold doors 26 having edges 23 in a closed state as shown, thereby to help protect against unauthorized opening of the doors by placing the doors into an open state (not shown), wherein the doors 22 are hinged 28 to the door frame 32, each on opposing door 22 sides, with the door sides approximately perpendicular to the door edges 23. The cabinet doors 24 also include handles 30 with the door opening movement 33 as shown for the cabinet type doors 24 as shown in FIG. 7, and the bi fold doors 26 also include handles 30, with bi fold door 26 opening movement 33 shown on the front and the back of the bi fold doors 26 as shown in FIG. 9. A first step is in providing a door security apparatus 20 that includes a channeled extension beam 34 having a longitudinal axis 35, the beam 34 is adapted to fit over and removably engage the pair of adjacent door edges 23 that are in the closed state. Also provided is the means 36 for manually selectively rotatably 38 clamping or manually selectively rotatably 40 unclamping the beam 34 to at least one door edge 23, wherein the doors 22 have increased protection against unauthorized opening, thus placing the doors 22 into a more secured closed state. The means 36 only manually selectively clamping or unclamping the beam 34 from the door edge 23 by applying the manual external force 42 in conjunction with manual forward 38 or manual reverse 40 rotation respectively. A next step is placing the beam 34 to engage the door edges 23 as shown. A further step is positioning the beam 34 by moving the beam 34 substantially parallel to the longitudinal axis 35 such that the means 36 for manually selectively rotatably clamping the beam 34 to the door edge 23 is positioned adjacent to at least one door 22 edge 23 and a portion of the beam 34 is engaged on the adjacent opposing door edge 23 as shown. Finally, a step of rotating the means 36 for manually selectively rotatably clamping or unclamping the beam 34 to the door edge 23 in forward rotation 38 and applying a manual lower external force 42 in conjunction with the forward manual rotation 38 to manually selectively rotatably clamp the beam 34 to the door edge 23, wherein the adjacent opposing doors 22 are placed into a more secured closed state to help protect against unauthorized opening of the doors 22 by placing the doors into the open state.

Optionally, a further step would compromise a final step of rotating said means 36 for manually selectively rotatably clamping or unclamping the beam 34 to the door edge 23 in reverse manual rotation 40 and applying a higher manual external force 42 to the means 36 in conjunction with the reverse manual rotation 40 to release the door edge 23 clamp of the beam 34 to remove the door security apparatus 20 from the doors 22, wherein the doors 22 can be manually placed into the open state. Note that the lower manual external force 42 and the higher manual external force 42 as previously described are only relative to each other in the amount of force required.

Referring particularly to FIG. 8, a method of using the alternative embodiment of the door security apparatus 20 is given that is adapted to assist in retaining a door 22 in a closed state as shown, thereby to help protect against unauthorized opening of the door 22 or cabinet door 24 by placing the door 22 into an open state (not shown), wherein the door 22 is hinged 28 to the door frame 32 on one side approximately perpendicular to the door edge 23. The door also includes a handle 30 with a door opening movement 33 as shown. A first step is in providing a door security apparatus 20 that includes a channeled extension beam 34 having a longitudinal axis 35, wherein a portion 86 of the beam 34 is adapted to fit over and removably engage the door edge 23, and a remainder 88 of the beam 34 being adjacent to the frame 32, wherein the door 22 is in the closed state. Also provided is a means 36 for manually selectively rotatably 38 clamping or manually selectably rotatably 40 unclamping the beam 34 to the door edge 23, wherein the door 22 has increased protection against unauthorized opening, thus placing the door 22 into a more secured closed state. The means 36 only manually selectively clamping or unclamping the beam 34 from the door edge 23 by applying an external manual force 42 in conjunction with manual forward 38 or manual reverse 40 rotation respectively. A next step is placing a portion 86 of the beam 34 to engage the door edge 23 and the remainder 88 of the beam 34 to be adjacent to the frame 32 as shown. A further step is positioning the beam 34 by moving the beam 34 substantially parallel to the longitudinal axis 35 such that the means 36 for manually selectively rotatably 38 clamping the beam 34 to the door edge 23 is positioned adjacent to the door edge 23 and the remainder 88 of the beam is adjacent to the frame 32. Finally, a step of rotating the means 36 for manually selectively rotatably clamping or unclamping the beam 34 to the door edge 23 in manual forward rotation 38 and applying a lower manual external force 42 in conjunction with the forward manual rotation 38 to manually selectively rotatably clamp the beam 34 to the door edge 23, wherein the door 22 is placed into a more secured closed state to help protect against unauthorized opening of the door 22 by placing the door into the open state.

Optionally, a further step would compromise a final step of rotating the means 36 for manually selectively rotatably clamping or unclamping the beam 34 to the door edge 23 in reverse manual rotation 40 and applying a higher manual external force 42 to the means 36 in conjunction with the reverse manual rotation 40 to release the door edge 23 clamp of the beam 34 to remove the door security apparatus 20 from the door 22, wherein the door 22 can be manually placed into the open state. Note that the lower manual external force 42 and the higher manual external force 42 as previously described are only relative to each other in the amount of force required.

CONCLUSION

Accordingly, the present invention of a Door Security Apparatus has been described with some degree of particularity directed to the embodiment(s) of the present invention. It should be appreciated, though, that the present invention is defined by the following claims construed in light of the prior art so modifications or changes may be made to the exemplary embodiment(s) of the present invention without departing from the inventive concepts contained therein.

The invention claimed is:

1. A door security apparatus, comprising:

(a) a channeled extension beam having a longitudinal axis, said beam is adapted to fit over and removably engage a pair of adjacent door edges of a pair of adjacent doors that are in a closed state, wherein said beam is operational to substantially secure the pair of adjacent doors in the closed state; and (b) a ratchet cap assembly having a threadable engagement with a beam externally threaded element adjacent to said beam with an aperture therethrough, said beam externally threaded element being substantially symmetric to a rotational axis that is substantially perpendicular to the beam longitudinal axis, said ratchet cap assembly only having rotational axial movement along said threadable engagement with the application of a manual external force approximately parallel to the rotational axis toward said beam, an extension member and a clamping member are both in slidable axial contact with said ratchet cap being disposed through said aperture therethrough and are operational to clamp and unclamp said beam to at least one door edge.

2. A door security apparatus according to claim 1 wherein said beam is constructed of materials selected from the group consisting essentially of polyethylene, polypropylene, and polyurethane materials.

3. A door security apparatus according to claim 1 wherein said ratchet cap assembly is constructed of materials selected from the group consisting essentially of polyethylene, polypropylene, and polyurethane materials.

4. A door security apparatus according to claim 1 further comprising a plurality of said ratchet cap assemblies.

5. A door security apparatus according to claim 1 wherein said ratchet cap assembly is constructed of a ratchet cap outer shell that has a rotationally releasably engagable interface with a ratchet cap insert, wherein said ratchet cap outer shell operationally accepts the manual external force and a manual forward or a manual reverse rotation and said ratchet cap insert having a threadable engagement with said beam externally threaded element with said ratchet cap insert being in slidable axial contact with said extension member and said clamping member.

6. A door security apparatus according to claim 5 wherein said ratchet cap assembly rotationally releasably engagable interface between said ratchet cap outer shell and said ratchet cap insert is constructed of a plurality of radially positioned axial protrusions disposed within said ratchet cap outer shell, each said protrusion including substantially parallel sides with one side for tightening and one side for loosening, said ratchet cap insert also includes a plurality of radially positioned axial nodes that are adjacent to said protrusions, each said node includes non parallel faces with a tightening face that is substantially parallel to said tightening side and a loosening face that forms an acute angle with said loosening side, said protrusions and nodes are operational to allow free rotational movement between said shell and insert without the application of the external manual force, also to allow forward tightening manual rotation resulting in rotational engagement between said shell and insert upon the manual application of a lower external force and to allow reverse loosening manual rotation resulting in rotational engagement between said shell and insert upon the manual application of a higher external force.

7. A door security apparatus according to claim 1 wherein said ratchet cap assembly has indicia visibly disposed on said ratchet cap assembly that is operational to give instructions to a user for manually selectively rotatably clamping or unclamping said beam to at least one door edge.

8. A door security apparatus, wherein a door is hinged to a door frame on one side approximately perpendicular to a door edge, comprising:

(a) a channeled extension beam having a longitudinal axis, a portion of said beam is adapted to fit over and removably engage the door edge of the door and a remainder of said beam is adjacent to the frame, wherein the door is in a closed state, wherein said beam is operational to substantially secure the door in the closed state; and (b) a ratchet cap assembly having a threadable engagement with a beam externally threaded element adjacent to said beam with an aperture therethrough, said beam externally threaded element being substantially symmetric to a rotational axis that is substantially perpendicular to the beam longitudinal axis, said ratchet cap assembly only having rotational axial movement along said threadable engagement with the application of a manual external force approximately parallel to the rotational axis toward said beam, an extension member and a clamping member are both in slidable axial contact with said ratchet cap being disposed through said aperture therethrough and are operational to clamp and unclamp said beam to the door edge.

9. A door security apparatus according to claim 8 wherein said beam is constructed of materials selected from the group consisting essentially of polyethylene, polypropylene, and polyurethane materials.

10. A door security apparatus according to claim 8 wherein said ratchet cap assembly is constructed of materials selected from the group consisting essentially of polyethylene, polypropylene, and polyurethane materials.

11. A door security apparatus according to claim 8 further comprising a plurality of said ratchet cap assemblies.

12. A door security apparatus according to claim 8 wherein said ratchet cap assembly is constructed of a ratchet cap outer shell that has a rotationally releasably engagable interface with a ratchet cap insert, wherein said ratchet cap outer shell operationally accepts the manual external force and a manual forward or a manual reverse rotation and said ratchet cap insert having a threadable engagement with said beam externally threaded element with said ratchet cap insert being in slidable axial contact with said extension member and said clamping member.

13. A door security apparatus according to claim 12 wherein said ratchet cap assembly rotationally releasably engagable interface between said ratchet cap outer shell and said ratchet cap insert is constructed of a plurality of radially positioned axial protrusions disposed within said ratchet cap outer shell, each said protrusion includes substantially parallel sides with one side for tightening and one side for loosening, said ratchet cap insert also includes a plurality of radially positioned axial nodes that are adjacent to said protrusions, each said node includes non parallel faces with a tightening face that is substantially parallel to said tightening side and a loosening face that forms an acute angle with said loosening side, said protrusions and nodes are operational to allow free rotational movement between said shell and insert without the application of the external manual force, also to allow forward tightening manual rotation resulting in rotational engagement between said shell and insert upon the manual application of a lower external manual force and to allow reverse loosening manual rotation resulting in rotational engagement between said shell and insert upon the manual application of a higher manual external force.

14. A door security apparatus according to claim 8 wherein said ratchet cap assembly has indicia visibly disposed on said ratchet cap assembly that is operational to give instructions to a user for manually selectively rotatably clamping or unclamping said beam to at least one door edge.

15. A method of using a door security apparatus that is adapted to assist in retaining a pair of adjacent opposing doors having edges in a closed state, thereby to help protect against unauthorized opening of the doors by placing the doors into an open state, wherein the doors are hinged each on opposing door sides, with the door sides approximately perpendicular to the door edges, comprising the steps of:

(a) providing a door security apparatus that includes a channeled extension beam having a longitudinal axis, said beam is adapted to fit over and removably engage the pair of adjacent door edges that are in the closed state and a means for manually selectively rotatably clamping or unclamping said beam to at least one door edge, wherein the doors have increased protection against unauthorized opening, thus placing the doors into a more secured closed state, said means only manually selectively clamping or unclamping said beam from the door edge by applying a manual external force in conjunction with a manual forward or a manual reverse rotation respectively;

(b) placing said beam to engage the door edges to substantially secure the pair of adjacent door edges in the closed state;

(c) positioning said beam by moving said beam substantially parallel to the longitudinal axis such that said means for manually selectively rotatably clamping said beam to the door edge is positioned adjacent to at least one door edge and a portion of said beam is engaged to the adjacent opposing door edge;

(d) rotating said means for manually selectively rotatably clamping or unclamping said beam to the door edge in forward manual rotation and applying a lower manual external force in conjunction with the forward manual rotation to manually selectively rotatably clamp said beam to the door edge, wherein the adjacent opposing doors are further substantially secured in the closed state to help protect against unauthorized opening of the doors by placing the doors into the open state; and (e) rotating said means for manually selectively rotatably clamping or unclamping said beam to the door edge in reverse manual rotation and applying a higher manual external force to said means in conjunction with the reverse manual rotation to release the door edge clamp of said beam to remove said door security apparatus from the doors, wherein the doors can be manually placed into the open state.

16. A method of using a door security apparatus that is adapted to assist in retaining a door in a closed state, thereby to help protect against unauthorized opening of the door by placing the door into an open state, wherein the door is hinged to a door frame on one side approximately perpendicular to a door edge, comprising the steps of:

(a) providing a door security apparatus that includes a channeled extension beam having a longitudinal axis, a portion of said beam is adapted to fit over and removably engage the door edge, and a remainder of said beam is adjacent to the frame, wherein the door is in the closed state and a means for manually selectively rotatably clamping or unclamping said beam to the door edge, wherein the door has increased protection against unauthorized opening, thus placing the door into a more secured closed state, said means only manually selectively clamping or unclamping said beam from the door edge by applying a manual external force in conjunction with a manual forward or a manual reverse rotation respectively;

(b) placing said beam portion to engage the door edge and said beam remainder to be adjacent to the frame to substantially secure the door in the closed state;

(c) positioning said beam by moving said beam substantially parallel to the longitudinal axis such that said means for manually selectively rotatably clamping said beam to the door edge is positioned adjacent to the door edge and said remainder of said beam is adjacent to the frame;

(d) rotating said means for manually selectively rotatably clamping or unclamping said beam to the door edge in manual forward rotation and applying a lower manual external force in conjunction with the forward manual rotation to manually selectively rotatably clamp said beam to the door edge, wherein the door is further substantially secured in the closed state to help protect against unauthorized opening of the door by placing the door into the open state and;

(e) rotating said means for manually selectively rotatably clamping or unclamping said beam to the door edge in reverse manual rotation and applying a higher manual external force to said means in conjunction with the reverse manual rotation to release the door edge clamp of said beam to remove said door security apparatus from the door, wherein the door can be manually placed into the open state.

* * * * *